US005922457A

United States Patent [19]

Yanagisawa et al.

[11] Patent Number: 5,922,457

[45] Date of Patent: Jul. 13, 1999

[54] MATTE FINISHED COATED PAPER AND PROCESS FOR MANUFACTURING THE SAME

[75] Inventors: Kenji Yanagisawa, Amagasaki; Syunichi Uchimura; Terunobu Fukui, both of Nishinomiya, all of Japan

[73] Assignee: Oji Paper Co., Ltd., Tokyo, Japan

[21] Appl. No.: 08/945,566

[22] PCT Filed: Feb. 27, 1997

[86] PCT No.: PCT/JP97/00586

§ 371 Date: Oct. 23, 1997

§ 102(e) Date: Oct. 23, 1997

[87] PCT Pub. No.: WO97/32082

PCT Pub. Date: Sep. 4, 1997

[30] Foreign Application Priority Data

Feb. 29, 1996 [JP] Japan ..... 8-43779

[51] Int. Cl.[6] ..... B32B 23/08; B32B 27/10

[52] U.S. Cl. ..... 428/342; 427/391; 428/513

[58] Field of Search ..... 427/391; 428/195, 428/532.1, 913, 342, 513

[56] References Cited

U.S. PATENT DOCUMENTS

| | | | |
|---|---|---|---|
| 4,719,141 | 1/1988 | Lollier | 428/144 |
| 4,978,695 | 12/1990 | Hoshino et al. . | |
| 5,094,998 | 3/1992 | Hoshino et al. . | |
| 5,182,161 | 1/1993 | Noda et al. | 428/195 |
| 5,188,891 | 2/1993 | Takeda et al. | 428/323 |
| 5,677,067 | 10/1997 | Kojima et al. | 428/195 X |

FOREIGN PATENT DOCUMENTS 0 343 833 A3 11/1989 European Pat. Off. .

OTHER PUBLICATIONS

Database WPI, Section Ch, Week 9502, Derwent Publications Ltd., London, GB; Class A82, AN–95–009868, XP002075245 & JP 06 294 100 A (Mitsubishi Paper Mills Ltd), Apr. 1993.

Database WPI, Section Ch, Week 9435, Derwent Publications Ltd., London, GB; Class A12, AN 94–283867, XP 002075246 & JP 06 212 599 A (Nippon Seishi KK), Jan. 1993.

Database WPI, Section CH., Week 9311, Derwent Publications Ltd., London, GB; Class A28, AN–93–089163, XP 002075247 & JP 05033 296 A (Japan Synthetic Rubber Co Ltd), Jul. 1991.

*Primary Examiner*—Michael Lusignan
*Attorney, Agent, or Firm*—Michael J. Striker

[57] ABSTRACT

The matte finished coated paper is a paper web having a smoothness of 0.5 to 20 seconds, when measured pursuant to JIS P8119, and a surface roughness Ra of 3.2 to 7.0 μm, when measured pursuant to JIS B0601, provided with a surface coating on at least one side containing polyolefin resin particles, an adhesive and a pigment. The pigment includes porous particles of organic pigment material and calcium carbonate particles. The porous particles of organic pigment material have an oil absorbancy of 80 to 400 ml/100 g when measured pursuant to JIS K5101, each calcium carbonate particle has an average particle diameter of 1.0 to 10 μm and each polyolefin resin particle has an average diameter of 8 to 30 μm. The surface coating has a degree of gloss in a range of from 1 to 10%, when measured pursuant to JIS P8142 at 75° C., a smoothness in a range of from 1 to 25 seconds, when measured pursuant to JIS P8119, and a surface roughness Ra in a range of from 2.0 μm to 6.0 μm when measured pursuant to JIS B0601.

4 Claims, No Drawings

MATTE FINISHED COATED PAPER AND PROCESS FOR MANUFACTURING THE SAME

BACKGROUND OF THE INVENTION

1. Field of the Invention

The present invention relates to matte finished coated paper. More particularly, the present invention relates to matte finished coated paper obtained by means of applying a surface coating of a pigment to at least one side of a web to provide the appearance similar to that of uncoated papers. The paper with such a surface coating is resistant to scratch marks. When subjected to printing, the paper is superior in dot reproduction and is capable of developing colors clearly and setting inks for a short time.

2. Prior Art

Coated paper is manufactured with a surface coating of a pigment provided on either or both sides of a web. Typical paper web is made from a number of cellulose fibers entangled. The web has irregular surfaces that sometimes include pores between entangled fibers. Making a print on such surface can reproduce dots insufficiently and the paper has higher capability for ink penetration than those having a surface coating. As a result, a printed image has only less distinguishable tone and/or contrast. Coated paper is a solution against such disadvantages. The coated paper is obtained by application of a surface coating based on a pigment and an adhesive to at least one side of the web. The paper may be passed between calendar rolls, if necessary. The resultant coated paper has improved smoothness. Therefore, it is considerably superior in dot reproduction and is capable of developing colors more clearly and setting inks for a shorter time as compared with uncoated papers. However, the surface coating and/or the calendaring operation used to improve the smoothness and gloss may more or less deteriorate the appearance of the paper.

Taking the above into consideration, there has been increasing demands towards matte finished coated paper that is a kind of coated paper but could have the appearance similar to ordinary uncoated papers. One example of known matte finished coated paper is described in Japanese Patent Laid-open Hei. 3-113094 in which original paper is embossed and the emboss in the original paper is reproduced in the coat layer on the surface of the original paper. Another example is the matte finished coated paper as described in Japanese Patent Laid-open No. 7-166492 that is manufactured without any calendaring process. Instead, it is manufactured by means of providing a surface coating containing an inorganic pigment and a hollow organic pigment with cushioning property on either or both sides of a web. In this coated paper, the hollow organic pigment having the cushioning property accounts for 15–85% by weight relative to the total amount of the pigment contained in the surface coating. The surface coating has a surface roughness Rmax of between 20 $\mu$m and 100 $\mu$m.

The closer appearance to an uncoated paper the matte finished coated paper has, the worse the printability is. To improve the printability of the coated surface tends to deteriorate the appearance. Therefore, it is considerably difficult to provide compatibility between the appearance and the printability. Furthermore, the coated surface of the matte finished coated paper would have a higher gloss when contacted with and scratched by something. Unfavorably, this may generate so-called scratch marks.

SUMMARY OF THE INVENTION

An object of the present invention is to provide a matte finished coated paper that has a surface coating of a pigment but is similar in appearance to an uncoated paper, which is superior in dot reproduction and is capable of developing colors clearly and setting inks for a short time and which is resistant to scratch marks when scratched by something.

The present inventors have found that matte finished coated paper having desired properties can be obtained by means of applying a surface coating containing a pigment at least 33% by weight of which is formed of a specific organic pigment having a high oil absorbency and a specific inorganic pigment to a certain web, and thus imparting specific surface physical properties to the surface of the surface coating of the pigment.

More specifically, the matte finished coated paper according to the present invention comprises a surface coating based on a pigment and an adhesive, the coating being applied to at least one side of a web. The web has a smoothness of 0.5 to 20 seconds, when measured pursuant to JIS P8119, and has a surface roughness Ra of 3.2 to 7.0 $\mu$m, when measured pursuant to JIS B0601. The aforementioned surface coating of the pigment contains 3–14% by weight of porous particles of an organic pigment relative to the total amount of the pigment, the porous particles of the organic pigment each having an oil absorbency of 80 to 400 ml/100 g when measured pursuant to JIS K5101. In addition, the surface coating contains calcium carbonate particles in an amount of 30–97% by weight relative to the total amount of the pigment, the calcium carbonate particles each having an average particle diameter of 1.0 to 10 $\mu$m. The surface coating satisfies physical properties of:

I. a degree of gloss of 1–10% (measurement condition: 75°) when measured pursuant to JIS P8142, II. a smoothness of 1–25 seconds when measured pursuant to JIS P8119, and II. a surface roughness Ra of 2.0 $\mu$m to 6.0 $\mu$m when measured pursuant to JIS B0601.

The surface coating of the matte finished coated paper according to the present invention is required to contain the porous particles of the organic pigment each having the oil absorbency of 80–400 ml/100 g, preferably 80–300 ml/100 g, when measured pursuant to JIS K5101, in an amount of from 3 to 14% by weight relative to the total amount of the pigment contained in the surface coating. The average particle diameter of the porous particle of the organic pigment in the surface coating is not limited specifically but is preferably in a range of from 0.1 to 10 $\mu$m.

In the present invention, the important factors are the amount of the porous particles of the organic pigment contained in the surface coating and the oil absorbency thereof. The particles of the organic pigment may be either hollow solid or aggregated shape when these two conditions are satisfied. Particles of an organic pigment having a perforated hole are applicable to the organic pigment in the present invention when the oil absorbency is within the above-mentioned range.

A scratch mark is more easily generated when the surface coating contains such hollow particles. Because particles of the organic pigment are easily deformed by an external force when having a gap (closed cell) therein isolated from outside the particles. In the present invention, the amount of the organic pigment in the surface coating is limited to 14% at the maximum relative to the total amount of the pigment. This allows effective restriction of the scratch mark even when the particles of the organic pigment are hollow. On the other hand, the scratch mark tends to be generated when the amount of the porous particles of the organic pigment in the surface coating of the pigment exceeds 14% by weight even if the oil absorbency thereof is within the above-mentioned range.

The particles of the organic pigment used in the present invention are considered porous because depressed portions are found in the surface when observed through a scanning electron microscope (×20,000).

The capability for setting inks on the surface coating is deteriorated when the porous particles of the organic pigment account for less than 3% by weight relative to the total amount of the pigment. This capability is also deteriorated when the porous particle of the organic pigment has the oil absorbency of below 80 ml/100 g. The deterioration of the ink setting capability sometimes results in set-off of the ink. The scratch mark tends to be generated when the amount of the porous particles of the organic pigment exceeds 14% by weight relative to the total amount of the pigment. When the porous particle of the organic pigment has the oil absorbency of higher than 400 ml/100 g, the surface coating of the pigment absorbs much ink, which makes it impossible to keep a high density of the ink used for a printed image.

Examples of the porous particles of the organic pigment applicable to the present invention include urea-formaldehyde resin particles or styrene-acryl based aggregated porous particles of which manufacturing method is disclosed in Japanese Patent Laid-open No. 2-70741.

It is also necessary that the surface coating of the present invention contains calcium carbonate particles each having an average particle diameter of 1.0 to 10 μm, in an amount of 30–97% by weight relative to the total amount of the pigment therein. The surface coating may have an excessively high degree of gloss or may tend to carry a scratch mark when the calcium carbonate particle has an average particle diameter of smaller than 1.0 μm. When it is larger than 10 μm, ink would significantly penetrates into the surface coating of the pigment, so that it is impossible to keep a high density of the ink used for a printed image. Both cases are not preferable.

Non-uniformity of gloss on the surface of the surface coating of the matte finished coated paper, which is generated by local scratching thereof, is expected to result from orientation of the pigment contained in the surface coating of the pigment. Generation of such scratch mark (non-uniformity of gloss) can be prevented effectively by means of containing the calcium carbonate particles having the above-mentioned average particle diameter in the amount of the above-mentioned range in the surface coating of the pigment.

In the present invention, particles of either ground calcium carbonate or precipitated calcium carbonate can be used. The average particle diameter thereof means a particle diameter obtained when an accumulated weight of particle size distribution is 50%, measured with Sedigraph 5000 particle size analyzer (available from Shimadzu Corporation).

The surface coating of the matte finished coated paper according to the present invention may contain, if necessary, one or more of ordinary pigments for coated paper. Examples of such pigments include inorganic pigments such as kaolin, calcined kaolin, structured kaolin, delaminated kaolin, amorphous silica, zinc oxide, zinc hydroxide, aluminum oxide, aluminum hydroxide, barium sulfate, talc, satin white, titanium dioxide, aluminum silicate, magnesium silicate, magnesium carbonate, diatomaceous earth, bentonite, and sericite; and organic pigments having an oil absorbency not within the above-mentioned range and having no closed cell. These pigments may be added as the pigment along with the above-mentioned porous particles of the organic pigment and calcium carbonate. If these pigments are used, it is preferable that the additional pigments are in total less than 67% by weight relative to the total amount of the pigment contained in the surface coating.

A better mode of the matte finished coated paper according to the present invention contains in the surface coating 2.5–5.0% by weight of polyolefin resin particles relative to the total amount of the pigment, along with the above-mentioned porous particles of the organic pigment and calcium carbonate. In this event, the polyolefin resin particle has an average particle diameter of 8–30 μm. Presence of the polyolefin resin particles further restricts a possibility of scratch mark generation. The average particle diameter of the polyolefin resin particle means the particle diameter obtained when the accumulated weight of particle size distribution is 50%, measured by laser diffraction particle size analyzer.

Though unclear why the presence of the polyolefin resin particles can further restrict generation of the scratch marks, it is expected that the polyolefin resin particles distributed over the surface coating act as a buffer when it is scratched by something.

No remarkable effect may be obtained on the restriction of the scratch mark when the polyolefin resin particle has an average particle diameter of smaller than 8 μm or when a polyolefin content is less than 2.5% by weight of the total amount of the pigment. On the other hand, when the polyolefin resin particle has an average particle diameter of larger than 30 μm or when a polyolefin content is more than 5% by weight, the capability of developing colors may be deteriorated on the surface coating of the pigment.

As the adhesive component in the surface coating of the pigment according to the present invention, any polymer latex can be used that is commonly used for making coated paper and matte finished coated paper. Of these, it is preferable to use 15–40% by weight, in terms of solid matter, of polymer latex having a gel content of 5–50% relative to the total amount of pigment in the surface coating of the pigment.

The scratch mark may be prevented only insufficiently when the polymer latex has a gel content of less than 5%. The same holds when a content of the polymer latex in the surface coating is less than 15% by weight, in terms of solid matter, relative to the total amount of the pigment. The scratch mark can be restricted in a satisfactory level when the polymer latex has a gel content of more than 50%. The scratch mark is also restricted when the surface coating has a content of the polymer latex of more than 40% by weight, in terms of solid matter, relative to the total amount of the pigment. However, it may be impossible to impart good printability to the surface coating of the pigment.

In the present invention, the gel content in the polymer latex means a value obtained according to the following.

Measurement of Gel Content in Polymer Latex

An aqueous solution of sodium hydroxide was used to adjust pH of the polymer latex to 8.0, and then a Teflon frame of 1.5 mm thick was placed on a Teflon plate. The latex sample to be measured was poured into the frame and allowed to dry for day and night. It was further dried under reduced pressure to produce a film of approximately 1 mm thick. Approximately 1 g of the film was weighed accurately and placed into an Erlenmeyer flask equipped with a ground-in-stopper along with toluene and stayed for two days and nights. Subsequently, it was filtered through a metal screen of 325 mesh and was dried. Then, a toluene-insoluble component on the screen was measured. The data obtained was used for the following equation to calculate the gel content (%) in the latex:

Gel content (%)=[film weight (g) on the metal screen/sample weight (g)]×100.

The gel content in the latex may be adjusted by means of changing composition of monomers to be copolymerized, a mixing ratio, an amount and type of polymerization initiators, chain transfer agents, and terminators, or polymerization conditions such as a reaction temperature.

Examples of the polymer latex used in the present invention include conjugate diene latex such as styrene-butadiene copolymer latex, acryl latex represented by latex of polymers or copolymers of acrylate and/or methacrylate, and vinyl latex represented by ethylene-vinyl acetate copolymer latex. Along with styrene-butadiene, modified styrene-butadiene copolymer latex may be obtained as the polymer latex having a gel content of 5–50%, that is obtained by means of reacting monomers such as acrylate, methacrylate, acrylic acid, itaconic acid, and crotonic acid.

The surface coating of the matte finished coated paper according to the present invention may contain, if necessary, an adhesive other than the above-mentioned latex, as long as it isn't apart from the object of the present invention. Those applicable as such adhesive may be proteins such as casein, soybean protein, and synthetic protein, starches such as oxidized starch, cellulose derivatives such as polyvinyl alcohol, carboxymethyl cellulose, and methyl cellulose, and olefin-maleic anhydride copolymers.

Next, a process for manufacturing the matte finished coated paper according to the present invention is described.

A web supporting the surface coating of the pigment of the present invention may be any one of acid paper or neutral paper having a basis weight of 30–400 g/m$^2$ that are used in common papermaking fields. For making the paper web, a Fourdrinier paper machine, a cylinder paper machine, twin-wire paper machine, a combination paper machine of Fourdrinier-cylinder type, and an on-top twin-wire paper machine may be employed as desired.

Pulp as the stock for the web may be chemical pulps from wood or non-wooden material, mechanical pulps, and recycled pulps. In addition, such paper web may also be applied that is obtained by means of pre-coating a web with a size press coater or that is obtained by means of patterning on the surface thereof with a blanket and so on in the pressing process by the paper machine.

However, it is necessary to use the web having a smoothness of 0.5–20 seconds when measured pursuant to JIS P8119 and having a surface roughness Ra of 3.2–7.0 μm when measured pursuant to JIS B0601 to obtain an expected effect of the present invention.

When the smoothness of the web exceeds 20 seconds or when the surface roughness Ra thereof is smaller than 3.2 μm, the matte finished coated paper cannot be obtained that has the appearance of natural paper, i.e., the appearance like an uncoated paper even with the surface coating of the pigment of the present invention. When the web used has a smoothness of below 0.5 seconds or a surface roughness Ra exceeding 7.0 μm, the printability of the surface coating of the pigment may be deteriorated even with a specific surface coating of a pigment according to the present invention.

An aqueous coating solution used for the surface coating according to the present invention is prepared to contain 3–14% by weight of porous particles of the organic pigment each having the oil absorbency of 80–400 ml/100 g, when measured pursuant to JIS K5101, relative to the total amount of the pigment mixed in the coating solution, 30–97% by weight of calcium carbonate particles each having an average particle diameter of 1.0–10 μm, relative to the total amount of the pigment mixed in the coating solution, and 15–40% by weight, in terms of solid matter, of polymer latex having a gel content of preferably 5–50%. The coating solution may further contain polyolefin resin particles having an average particle diameter of 8–30 μm when measured by the laser diffraction particle size analyzer, in an amount of 2.5–5% by weight relative to the total amount of the pigment. Furthermore, it may contain typical adhesives for coated paper, antifoaming agents, colorants, releasing agents, rheology modifiers, water resistance agent, and antiseptics, if necessary. The concentration of the solid matter in the aqueous coating solution is typically in a range of 20–70% by weight. However, it is preferable that the concentration is adjusted in a range of 25–65% by weight, taking coatability and operability into consideration.

It is preferable to adjust the amount of the aqueous coating solution applied to the web to 2–20 g/m$^2$, preferably 3–15 g/m$^2$ per surface after being dried. The coating amount of less than 2 g/m$^2$ affects disadvantageously the development of ink density after printing, which may inhibit to provide uniform ink absorptivity and receptivity. On the other hand, the amount exceeding 20 g/m$^2$ may result in the degree of gloss of higher than 10% when measured pursuant to JIS P8142, or in the smoothness of above 25 seconds when measured pursuant to JIS P8119. Furthermore, the surface roughness Ra may be below 2.0 μm when measured pursuant to JIS B0601. As a result of these, the appearance after coating is less different from conventional matte finished coated paper, and the appearance like an uncoated paper, which is intended by the present invention may not be obtained. A coating machine for use in forming the surface coating of the pigment on the web is not limited specifically. It may be any one of known coating machines used in the papermaking fields. Specific examples include an air knife coater, a blade coater, a roll coater, a reverse roll coater, a bar coater, a curtain coater, a slot die coater, a gravure coater, a champlex coater, a size press coater, or a billblate coater. Of these machines, the air knife coater is more preferable that can reproduce the irregularity of the web faithfully. The surface coating of the present invention may be a single layer on the web or be a laminate of two or more layers. For drying the surface coating of the pigment after coating, any one of conventional drying methods can be used which include steam heating, hot air heating, heating with a gas heater, high frequency heating, heating with an electric heater, heating with an infrared-ray heater, laser heating, and electronic radiation heating. The coated paper thus obtained may be subjected to calendaring, if necessary, as long as the surface properties defined by the present invention are not deteriorated.

However, independent of which one of the coating techniques is used and of whether or not the calendaring is performed, it is important that the surface coating of the mat coated paper according to the present invention is finished to satisfy the following three conditions:

I. a degree of gloss in a range of 1–10% (measurement condition: 75°) when measured pursuant to JIS P8142, II. a smoothness in a range of 1–25 seconds when measured pursuant to JIS P8119, and III. a surface roughness Ra in a range of 2.0 μm to 6.0 μm when measured pursuant to JIS B0601.

The degree of gloss should be determined in the range of 1–10% in the surface coating of the pigment in I because it is necessary for making the appearance thereof be closer to uncoated papers. When it is lower than 1% the appearance like uncoated papers can be obtained. However, the capability of developing colors clearly and print smoothness are deteriorated, providing unsatisfactory printability. On the other hand, when it exceeds 10%, the appearance is closer to that of the coated papers and is thus not preferable.

To determine the smoothness in II and the surface roughness Ra in III to 1–25 seconds and 2.0–6.0 μm, respectively, is also necessary to provide the appearance and the feel thereof that are closer to those of uncoated papers. The capability of developing colors clearly is deteriorated, providing unsatisfactory printability when the smoothness is below 1 second or the surface roughness Ra exceeds 6.0 μm. On the contrary, when the smoothness exceeds 25 seconds or the surface roughness Ra is below 2.0 μm, the surface appearance of the surface coating of the pigment becomes closer to that of the coated paper and is thus not preferable.

The present invention is described more in detail in conjunction with a set of examples and comparative examples. However, it is understood that the present invention is not limited thereto. The term "part(s)" and "%" in the description mean "part(s) by weight" and "% by weight" unless otherwise specified.

EXAMPLE 1

Slurry of pigment having 47% solid matter concentration was prepared using a cowless dissolver by means of adding 0.1 parts (in terms of solid matter) of dispersant into a mixture of 30 parts of kaolin particles (each having an average particle diameter of 0.55 μm), 60 parts of ground calcium carbonate particles (each having the average particle diameter of 2.1 μm), and 10 parts of aggregated porous particles of an organic pigment (each having the oil absorbency of 250 ml/100 g) which is made of an urea-formaldehyde resin. The dispersant used is available from Toa Synthesis Chemical Industries Co., Ltd. under the trade name of ALON T-40. The kaolin particle used is available from Engelhard Corporation under the trade name of HT. The ground calcium carbonate particles used is available from Bihokufunka Kogyo K.K. under the trade name of SOFUTON 1800. The porous particle used is available from Mitsui Toatsu Chemicals, Inc. under the trade name of U-PEARL C-122.

Next, 25 parts of styrene-butadiene copolymer latex (trade name: Nipol LX 407FT-2047 available from Nippon Zeon Co., Ltd.) and 3 parts of oxidized starch (trade name: ACE A available from Oji Corn Starch Co., Ltd.) were added to the pigment slurry as adhesives. The copolymer latex used has the glass transition temperature of 38° C. and the gel content of 38%, and the oxidized starch was previously made into a paste state before use. Then, water was added to the mixture to produce an aqueous coating composition having the solid matter concentration of 40%.

The above-mentioned aqueous coating composition was coated on both sides of a web to be 8 g/m$^2$ per surface after being dried. The web used comprises 10% of bleached cotton linter pulp, 20% of NBKP, and 70% of LBKP, and that has the basis weight of 150 g/m$^2$, the smoothness of 15 seconds, the surface roughness Ra of 3.6 μm. It was dried with hot air to produce coated paper having the water content of 5%.

EXAMPLE 2

High-density polyethylene powder (trade name: MIPELON XM 221-U available from Mitsui Petrochemical Industries, Ltd.) was dispersed into water with a nonion surfactant to obtain a dispersion. The powder used has the average particle diameter of 27.5 μm when measured by the laser diffraction particle size analyzer (measurement apparatus: SALD-2000 available from Shimadzu Corporation). The dispersion was added to the aqueous coating composition used in Example 1 to prepare an aqueous coating composition containing 3.0 parts, relative to 100 parts of pigment in the composition, of high-density polyethylene powder as solid matter.

Example 1 was repeated to produce a sheet of coated paper except that the coating composition used in Example 1 was replaced by the above-mentioned coating composition.

EXAMPLE 3

Example 1 was repeated to produce a sheet of coated paper except that aggregated porous particles of an organic pigment (trade name: GUROSUDERU 110M available from Mitsui Toatsu Chemicals, Inc.) each having the oil absorbency of 90 ml/100 g were used in place of the organic pigment.

EXAMPLE 4

An aqueous coating composition containing 4 parts of polyethylene wax, as solid matter, relative to 100 parts of pigment was prepared by means of adding a polyethylene wax emulsion (trade name: SLIP-AYD SL-300 available from San Nopco Ltd.) having the average particle diameter of 9.1 μm, when measured by the laser diffraction particle size analyzer (measurement apparatus: SALD-2000 available from Shimadzu Corporation) into the aqueous coating composition used in Example 3.

Example 3 was repeated to produce a sheet of coated paper except that the coating composition used in Example 3 was replaced by the above-mentioned coating composition.

EXAMPLE 5

Example 4 was repeated to produce a sheet of coated paper except that the copolymer latex used in Example 4 was replaced by a styrene-butadiene copolymer latex (trade name: T2648 available from Japan Synthetic Rubber Co., Ltd.) having the glass transition temperature of 9° C. and the gel content of 10%.

EXAMPLE 6

Example 4 was repeated to produce a sheet of coated paper except that the copolymer latex used in Example 4 was replaced by 18 parts, in terms of solid matter relative to 100 parts of pigment, of styrene-butadiene copolymer latex (trade name: T2550 available from Japan Synthetic Rubber Co., Ltd.) having the glass transition temperature of −11° C. and the gel content of 88%.

EXAMPLE 7

Example 3 was repeated to produce a sheet of coated paper except for the following: calcium carbonate particles used in Example 3 was replaced by ground calcium carbonate particles (trade name: BF-100 available from Bihokufunka Kogyo K.K.) having the average particle diameter of 8.6 μm; and such slurry of pigment was used that has the mixing ratio of kaolin/ground calcium carbonate/organic pigment of 50/40/10.

EXAMPLE 8

Example 1 was repeated to produce a sheet of coated paper except that such slurry of pigment was used that has the mixing ratio of kaolin/ground calcium carbonate/organic pigment of 35/60/5.

EXAMPLE 9

Example 3 was repeated to produce a sheet of coated paper except that such slurry of pigment was used that has the mixing ratio of kaolin/ground calcium carbonate/organic pigment of 0/86/14 to use a pigment slurry having no kaolin mixed.

EXAMPLE 10

Example 4 was repeated to produce a sheet of coated paper except that used were hollow particles of an organic porous pigment each having the oil absorbency of 160 ml/100 g and a web having the basis weight of 150 g/m$^2$. The web had smoothness of 20 seconds and surface roughness Ra of 3.3 $\mu$m. The hollow particle of the pigment used is available from Rohm and Hass Company under the trade name of ROPAQUE HP-91. The web used comprises 10% of NBKP and 90% of LBKP.

EXAMPLE 11

Example 4 was repeated to produce a sheet of coated paper except that porous particles of an organic pigment with perforated hole (trade name: GUROSUDERU 62S available from Mitsui Toatsu Chemicals, Inc.) each having the oil absorbency of 150 ml/100 g were used.

EXAMPLE 12

Example 4 was repeated to produce a sheet of coated paper except that web was used in place of the web in Example 4. The web was used has the smoothness of 1 second, the surface roughness Ra of 6.8 $\mu$m, and the basis weight of 150 g/m$^2$, made from 5% of NBKP and 95% of LBKP and embossed with a blanket at a press station in a machine.

Comparative example 1

Example 1 was repeated to produce a sheet of coated paper except that such slurry of pigment was used that has the mixing ratio of kaolin/ground calcium carbonate/organic pigment of 30/50/20 in preparation of the aqueous coating solution of Example 1.

Comparative example 2

Example 1 was repeated to produce a sheet of coated paper except that such slurry of pigment was used that has the mixing ratio of kaolin/ground calcium carbonate/organic pigment of 65/25/10 in preparation of the aqueous coating solution of Example 1.

Comparative example 3

Example 1 was repeated to produce a sheet of coated paper except that such slurry of pigment was used that has the mixing ratio of kaolin/ground calcium carbonate/organic pigment of 35/65/0 in preparation of the aqueous coating solution of Example 1. As apparent from the above, the slurry used contains no organic pigment.

Comparative example 4

Example 4 was repeated to produce a sheet of coated paper except that a solid organic pigment having the oil absorbency of 75 ml/100 g was used in place of the organic pigment in the aqueous coating solution used in Example 4. The pigment used is available from Mitsui Toatsu Chemicals, Inc. under the trade name of GUROSUDERU 201S.

Comparative example 5

Example 10 was repeated to produce a sheet of coated paper except that such slurry of pigment was used that has the mixing ratio of kaolin/ground calcium carbonate/organic pigment of 30/54/16 in preparation of the aqueous coating solution of Example 10.

Comparative example 6

Example 1 was repeated to produce a sheet of coated paper except that ground calcium carbonate particles (trade name: BF-300 available from Bihokufunka Kogyo K.K.) each having the average particle diameter of 16 $\mu$m were used in place of calcium carbonate used in the aqueous coating solution in Example 1.

Comparative example 7

Example 4 was repeated to produce a sheet of coated paper except that ground calcium carbonate particles (trade name: Hydrocarb-90 available from Bihokufunka Kogyo K.K.) each having the average particle diameter of 0.7 $\mu$m were used in place of calcium carbonate used in the aqueous coating solution in Example 1.

Comparative example 8

Example 3 was repeated to produce a sheet of coated paper except that a web (smoothness of 24 seconds and surface roughness Ra of 3.0 $\mu$m) having the basis weight of 150 g/m$^2$, made from 100% of LBKP was used in place of the web in Example 3.

The coated paper obtained in the above Examples 1–12 and Comparative examples 1–8 were evaluated for the following properties on the surface coating of the pigment.

Degree of Gloss

It was measured at an angle of 75° pursuant to JIS P8142.

Smoothness

It was measured pursuant to JIS P8119.

Surface Roughness Ra

It was measured pursuant to JIS B0601 by using a Surftest 201 series 178 (available from Mitutoyo Mg. Co., Ltd.) under conditions of a cut-off value of 0.8 mm and a measurement length of 4 mm.

Scratch Mark

A piece of the coated paper obtained in Examples 1–12 and Comparative examples 1–8 was fixed by using a rub fastness tester for dyed products (available from K.K. Toyo Seiki Seisakusho). The surface thereof was contacted with a metal surface of a movable section with the load of 600 g to perform frictional motion of one cycle. The difference in gloss was visually evaluated according to the following criteria between the scratched portion and the non-scratched portion.

◎: The difference in gloss was hardly observed between the scratched and non-scratched portions.

○: The difference in gloss was slightly observed between the scratched and non-scratched portions.

X: The difference in gloss was clearly observed between the scratched and non-scratched portions. The level of the difference in gloss was a problem by the practical considerations.

Development of Ink Density

Optical density of four-color solid section of black, cyan, red, and yellow, obtained by simultaneous printing with a sheet-fed offset printer, was measured by using a Macbeth optical densitometer (measurement apparatus: RD-914 available from GretagMacbeth). A larger value corresponds to a higher ink density and better development of ink colors.

Appearance like Uncoated Paper

Feel (by hand) and appearance of the coated paper were evaluated according to the following criteria:

◎: Unlike conventional matte finished coated paper, it has good feel, especially good slip, and is similar in appearance to an uncoated paper, with good appearance like an uncoated paper.

○: Unlike conventional matte finished coated paper, it is considerably similar in appearance to an uncoated paper and has good appearance, but is slightly inferior in feel, especially in slip feel, to an uncoated paper.

X: It is undistinguishable from conventional matte finished coated paper and no desired effect is obtained.

Ink Setting Rate

A sheet-fed offset printer was used to print four colors per surface at a rate of 8,000 sheets per hour and 3,000 sheets of printed paper were piled up. Then, ten sheets, i.e., 101th to 110th sheets from the bottom were taken out to evaluate mean set-off conditions of four-color solid portion according to the following criteria:

◎: It was good with no set-off observed.

○: Set-off was slightly observed but was not troublesome in practice.

X: Set-off was bad and was troublesome in practice.

TABLE 1

| | Gloss (%) | Smoothness (sec.) | Surface Roughness Ra (μm) | Scratch Mark | Development of Ink Density | Appearance like Uncoated Paper | Ink Setting Rate |
|---|---|---|---|---|---|---|---|
| Ex. 1 | 7 | 17 | 3.0 | ○ | 1.75 | ○ | ○ |
| Ex. 2 | 6 | 16 | 3.2 | ◎ | 1.73 | ◎ | ○ |
| Ex. 3 | 8 | 20 | 2.8 | ○ | 1.93 | ○ | ○ |
| Ex. 4 | 8 | 20 | 2.9 | ◎ | 1.92 | ◎ | ○ |
| Ex. 5 | 8 | 20 | 2.9 | ◎ | 1.91 | ◎ | ◎ |
| Ex. 6 | 8 | 20 | 2.9 | ○ | 1.90 | ◎ | ○ |
| Ex. 7 | 5 | 14 | 3.4 | ◎ | 1.73 | ○ | ○ |
| Ex. 8 | 8 | 19 | 3.0 | ○ | 1.83 | ○ | ○ |
| Ex. 9 | 4 | 14 | 3.3 | ◎ | 1.72 | ○ | ○ |
| Ex. 10 | 10 | 24 | 2.2 | ○ | 1.96 | ○ | ○ |
| Ex. 11 | 7 | 20 | 2.9 | ◎ | 1.90 | ◎ | ◎ |
| Ex. 12 | 3 | 4 | 5.9 | ○ | 1.70 | ◎ | ○ |
| Comp. 1 | 6 | 18 | 3.3 | ○ | 1.58 | ○ | ◎ |
| Comp. 2 | 10 | 25 | 2.8 | X | 1.81 | ○ | ◎ |
| Comp. 3 | 7 | 20 | 3.1 | ◎ | 1.84 | ○ | X |
| Comp. 4 | 9 | 22 | 2.9 | ◎ | 1.93 | ○ | X |
| Comp. 5 | 15 | 30 | 2.0 | X | 2.00 | X | X |
| Comp. 6 | 2 | 7 | 3.8 | ◎ | 1.54 | ○ | X |
| Comp. 7 | 13 | 32 | 2.6 | X | 1.95 | X | ◎ |
| Comp. 8 | 13 | 30 | 1.9 | ○ | 1.99 | X | ○ |

As apparent from Table 1, the matte finished coated paper obtained in Examples of the present invention has the appearance like an uncoated paper, that is similar to the base paper before coating, and is substantially free from scratch mark with good printability.

We claim:

1. A matte finished coated paper comprising a web having a smoothness of 0.5 to 20 seconds, when measured pursuant to JIS P8119, and a surface roughness Ra of 3.2 to 7.0 μm when measured pursuant to JIS B0601; and a surface coating provided on at least one side of said web, said surface coating containing polyolefin resin particles and a pigment, said pigment including porous particles of an organic pigment material and calcium carbonate particles, wherein said surface coating comprises 2.5 to 5% by weight of said polyolefin resin particles, relative to a total amount of the pigment in said surface coating, from 3 to 14% by weight of said porous particles of said organic pigment material, relative to said total amount of the pigment, and from 30 to 97% by weight of calcium carbonate particles, relative to said total amount of said pigment, and wherein each of said porous particles of said organic pigment material have an oil absorbancy of 80 to 400 ml/100 g when measured pursuant to JIS K5101, each of said calcium carbonate particles have an average particle diameter of 1.0 to 10 μm and each of said polyolefin resin particles have an average diameter of 8 to 30 μm;

whereby said surface coating of the pigment has a degree of gloss in a range of from 1 to 10% when measured pursuant to JIS P8142 at 75° C., a smoothness in a range of from 1 to 25 seconds when measured pursuant to JIS P8119, and a surface roughness Ra in a range of from 2.0 μm to 6.0 μm when measured pursuant to JIS B0601.

2. The matte finished coated paper as defined in claim 1, wherein said surface coating contains 15 to 40% by weight, in terms of solid matter, of polymer latex relative to the total amount of said pigment in said surface coating, the polymer latex having a gel content of 5 to 50% by weight.

3. A process for manufacturing matte finished coated paper, said matte finished coated paper comprising a web having a smoothness of 0.5 to 20 seconds, when measured pursuant to JIS P8119, and a surface roughness Ra of 3.2 to 7.0 μm when measured pursuant to JIS B0601; and a surface coating provided on at least one side of said web, said surface coating containing polyolefin resin particles and a pigment, said pigment including porous particles of an organic pigment material and calcium carbonate particles, wherein said surface coating comprises 2.5 to 5% by weight of said polyolefin resin particles, relative to a total amount of the pigment in said surface coating, from 3 to 14% by weight of said porous particles of said organic pigment material, relative to said total amount of the pigment and from 30 to 97% by weight of calcium carbonate particles, relative to said total amount of said pigment, and wherein each of said porous particles of said organic pigment material have an oil absorbancy of 80 to 400 ml/100 g when measured pursuant to JIS K5101, each of said calcium carbonate particles have an average particle diameter of 1.0 to 10 $\mu$m and each of said polyolefin resin particles have an average diameter of 8 to 30 $\mu$m;

wherein said process comprises the steps of:

preparing an aqueous coating solution consisting essentially of water and sufficient amounts of said polyolefin resin particles, said porous particles of said organic pigment material and said calcium carbonate particles, so that said surface coating resulting from said process comprises said 3 to 14% by weight of said porous particles of said organic pigment material, relative to said total amount of the pigment and said 30 to 97% by weight of calcium carbonate particles, relative to said total amount of said pigment;

whereby said surface coating of the pigment has a degree of gloss in a range of from 1 to 10% when measured pursuant to JIS P8142 at 75° C., a smoothness in a range of from 1 to 25 seconds when measured pursuant to JIS P8119, and a surface roughness Ra in a range of from 2.0 $\mu$m to 6.0 $\mu$m when measured pursuant to JIS B0601.

4. The process as defined in claim 3 wherein said aqueous coating solution is applied to said web in an amount of from 2 to 20 g/m$^2$ per surface after drying.

* * * * *